US006464350B1

(12) United States Patent
Uchida

(10) Patent No.: US 6,464,350 B1
(45) Date of Patent: Oct. 15, 2002

(54) RECORDING APPARATUS

(75) Inventor: Haruo Uchida, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/188,685

(22) Filed: Nov. 10, 1998

(30) Foreign Application Priority Data

Dec. 11, 1997 (JP) ..... 9-310411

(51) Int. Cl.[7] ..... B41J 2/01
(52) U.S. Cl. ..... 347/104; 271/9.08; 400/624
(58) Field of Search ..... 347/104, 105; 271/9.08, 264, 158, 157; 400/624, 625, 636

(56) References Cited

U.S. PATENT DOCUMENTS

| | | | | |
|---|---|---|---|---|
| 4,723,129 A | | 2/1988 | Endo et al. | 346/1.1 |
| 4,740,796 A | | 4/1988 | Endo et al. | 346/1.1 |
| 5,485,990 A | * | 1/1996 | Kato | 271/9.08 |
| 5,511,770 A | * | 4/1996 | Okazaki | 271/4.01 |
| 5,536,000 A | | 7/1996 | Kelly | 271/189 |
| 5,580,041 A | | 12/1996 | Nakayama | 271/189 |
| 5,603,493 A | | 2/1997 | Kelly | 271/188 |
| 5,686,950 A | | 11/1997 | Hirakue | 347/104 |
| 5,767,884 A | * | 6/1998 | Bortolotti et al. | 347/102 |
| 5,785,312 A | * | 7/1998 | Krupica et al. | 271/264 |
| 6,050,565 A | * | 4/2000 | Fetherolf | 271/45 |
| 6,102,509 A | * | 8/2000 | Olson | 347/8 |
| 6,106,114 A | * | 8/2000 | Sugiyama | 347/104 |

FOREIGN PATENT DOCUMENTS

| | | |
|---|---|---|
| EP | 0 530 821 | 3/1993 |
| JP | 0832397 | 12/1996 |

OTHER PUBLICATIONS

Patent Abstracts of Japan, Kokai No. 08–323973, 1996.

* cited by examiner

*Primary Examiner*—Andrew H. Hirshfeld
*Assistant Examiner*—Darius N. Cone
(74) *Attorney, Agent, or Firm*—Fitzpatrick, Cella, Harper & Scinto

(57) ABSTRACT

This invention has as its object to make it possible to provide a recording apparatus in which even when a recording material of a different size is used, it can be prevented by a simple construction from rubbing against a recorded recording material already discharged to and supported on a recording material discharge supporting portion to thereby prevent the disturbance of the recording surface (image) thereof and improve the dischargeability and supportability of the recording material. A recording material discharge supporting unit is made removably mountable with respect to the main body of the recording apparatus, and the apparatus has a recording material holding member supported on the base member of the recording material discharge supporting unit by a recording material holding member holder and movable in the widthwise direction of the recording material, and a recording material holding member fixed onto the base member. The recording material holding members are characterized in that cams fixed to a cam shaft operatively associated with the rotative driving of a discharge roller are designed to be engaged with cam surfaces fixed to pivot shafts and pivotally moved about the pivot shafts to thereby change the recording material holding members to a holding position and a retracted position.

14 Claims, 10 Drawing Sheets

RECORDING APPARATUS

BACKGROUND OF THE INVENTION

1. Field of the Invention

This invention relates to a recording apparatus, and particularly to a recording apparatus in which before a recording material discharged from a main body of the recording apparatus is discharged to a discharged recording material supporting portion, the recording material is held to dry an ink, then after it is discharged to the supporting portion.

2. Related Background Art

Generally, conventional recording apparatuses are constructed such that recording materials on which recording has been effected are discharged onto a discharge tray. This construction is also widely adopted in ink jet recording apparatuses. In such an ink jet recording apparatus, normal recording, for example the recording of documents or tables having small recording density, suffers from no problem. However, if recording density is great as in color recording, when a recording material on which image has been recorded is discharged, there has been the problem that a leading end edge portion or a back face thereof rubs against recording materials already stacked on the discharge tray to cause disturbance or the like of the image on the recording surface thereof.

In order to solve the above-noted problem, according to the prior art, as shown in FIG. 10, a discharge tray 51 onto which a recording material S is discharged is provided with a pair of side rail members 52 and 53 rotatable about pivots 52*a* and 53*a*, respectively, and disposed in opposed relationship with each other with a predetermined interval therebetween. Outside these side rail members 52 and 53, there are provided wall surfaces 54 and 55 formed with recesses 54*a* and 55*a* into which the side rail members 52 and 53 can be pivotally moved in the directions of arrows a and b, respectively, and are retracted from the recording material S.

When the recording material S is discharged in a direction perpendicular to the surface of the recording material S of FIG. 10 (to this side in FIG. 10) by a discharge roller (not shown), the side rail members 52 and 53 are held in their closed positions as shown in FIG. 10 to support and hold the recording material S above the discharge stacker 56 of the discharge tray 51. In this state, ink discharged onto the recording surface of the recording material S already discharged onto the discharge stacker 56 can be dried and the stain of the image on the recording surface can be prevented.

Thereafter, the side rail members 52 and 53 may be rotated in the directions of arrows a and b, respectively, in FIG. 10 to thereby retract them from the recording material S, and the recording material S held by the side rail members 52 and 53 may be dropped onto the discharge stacker 56.

Also, in another prior art, a movable support arm for dropping a sheet to be a recording material onto a discharge tray after the sheet has arrived at the terminal position of a conveyance route is provided. When the sheet is moved along the conveyance route, the movable support arm is disposed so as to be selectively positioned on the lower surface of the central portion of the sheet synchronous with the sheet conveying operation, to thereby hold the sheet during recording on the upper portion of the discharge tray. Thereby, the ink of the sheet already supported on the discharge tray can be dried and the stain or the like of the recording surface thereof can be prevented.

In the prior art shown in FIG. 10, however, the side rail members 52 and 53 are disposed at the fixed position, and therefore the side rail members 52 and 53 are set at the position corresponding to the maximum size (e.g. size A3) of the recording material S discharged.

When the size of the recording material S used in the above-described construction is a size (e.g. size B5) smaller than the maximum size, there is a case where the recording material S can be held only by the side rail member (52 or 53) on one side, so that the recording material S on the side which is not held rubs against the recording material S already discharged onto the discharge stacker 56 to generate the disturbance or the like of the recording surface.

As a countermeasure for this, it is conceivable to set the diametral lengths of the side rail members 52 and 53 rotated about the rotation centers 52*a* and 53*a* greater to thereby widen the range for holding the recording material S. However, this leads to the problem that when the guide rail members 52 and 53 are rotated in the directions of arrows a and b in FIG. 10 about the rotation centers 52*a* and 53*a* to drop the recording material S onto the discharge stacker 56, the radius of the rotation of the side rail members 52 and 53 becomes large and a large space becomes necessary above the side rail members 52 and 53, whereby the apparatus becomes bulky.

Also, when the radius of the rotation of the side rail members 52 and 53 becomes large, if the recording material S held by the side rail members 52 and 53 is dropped onto the discharge stacker 56, the recording material S drops onto the discharge stacker 56 after it is once greatly raised upwardly. Therefore, there is the problem that the supported state of the recording material on the discharge stacker 56 during the drop thereof varies greatly, so that the supportability of the recording material on the discharge stacker 56 becomes bad, or the end portion of the recording material S remains on one side of the side rail members 52 and 53 to contact with a recording material S discharged subsequently.

Also, another prior art described previously copes with the problem arising when sheets of different sheet sizes or large sizes are used, but it is necessary to synchronize the movable support arm with the sheet conveying operation, which leads to the problem that the mechanism becomes complicated and the cost of the apparatus becomes high.

SUMMARY OF THE INVENTION

The present invention solves the above-noted problems and has the object to provide a recording apparatus in which even when a recording material of a different size is used, it is prevented from rubbing against a recorded recording material already discharged to and supported on a recording material discharge supporting portion, to thereby prevent the disturbance of the recording surface (image) thereof and to improve the dischargeability and supportability of the recording materials, by the simple construction.

To achieve the above object, according to the present invention, the recording apparatus has a recording material discharging and supporting portion for supporting thereon a recording material discharged, recording material holding means changeable to a holding position for holding the discharged recording material before it is discharged to the recording material discharging and supporting portion and a retracted position for supporting the recording material from its held state onto the recording material discharge supporting portion, and moving means for moving the position of the recording material holding means in conformity with the size of the discharged recording material.

According to the present invention, even when a recording material of a different size is discharged, the moving means moves the position of the recording material holding means in conformity with the size of the discharged recording material, so that the discharged recording material can be prevented from rubbing against a recorded recording material already discharged to the recording material discharge supporting portion, whereby the disturbance of the recording surface (image) thereof can be prevented, and the dischargeability and supportability thereof can be improved.

Also, when the change of the posture of the recording material holding means between the holding position and the retracted position is effected by the driving of recording material discharging means, existing driving means can be used to make the construction simple.

Also, the recording material discharging means has a discharging rotatable member for discharging the recording material, and in rotation in a direction in which the discharging rotatable member discharges the recording material, the recording material holding means is set in the holding position, while in rotation in the opposite direction, the recording material holding means is set in the retracted position.

Also, on the rotary shaft of the discharging rotatable member, there is provided a one-way clutch which does not transmit a driving force to the recording material holding means during the rotation of the discharging rotatable member in a direction to discharge the recording material, but transmits the driving force to the recording material holding means during the rotation thereof in a direction opposite thereto.

Also, with the recording material holding means changed from the holding position to the retracted position, even if the discharge of the recording material is completed and the recording material holding means is held in the retracted position, the rigidity of the recording material holding means against the external force applied by a falling object or the like thereto becomes great, which is preferable.

Also, the recording material holding means has a recording material holding member changeable to a holding position for holding the discharged recording material before it is discharged to the recording material discharge supporting portion and a retracted position for mounting the recording material from its held state onto the recording material discharge supporting portion, the moving means supports the recording material holding member, a recording material holding member holder movable from the position of the recording material holding member in conformity with the size of the discharged recording material is provided, and a grip portion operated for the movement of the recording material holding member holder serves also as a guide for the discharged recording material.

Also, in the driving system of the recording material holding means, there is provided a torque limiter for limiting the transmission of a driving force in a direction in which the holding means is changed from the holding position for holding the discharged recording material before it is discharged to the recording material discharge supporting portion to the retracted position for mounting the recording material on the recording material discharge supporting portion.

Also, in the driving system of the recording material holding means, there is a cam for changing the holding means from the holding position for holding the discharged recording material before it is discharged to the recording material discharge supporting portion to the retracted position for mounting the recording material on the recording material supporting portion, and constructing the cam and the recording material holding member to be engaged with each other within the range of movement of the recording material holding member holder is preferable.

Also, the recording material holding means is constructed such that the holding height thereof becomes greater in a direction away from the recording material discharging means for discharging the recording material, or that the holding position comes into the inside of the recording material in a direction away from the recording material discharging means.

Also, a recording material discharge supporting unit comprising a recording material discharge supporting portion for supporting thereon the recording material discharged from a recording apparatus main body, and recording material holding means changeable to a holding position for holding the recording material discharged from the main body before it is discharged to the recording material discharge supporting portion and a retracted position for supporting the recording material from its held state onto the recording material discharge supporting portion, and the recording material discharge supporting portion and the recording material holding means are integrally made into a unit. The recording material discharge supporting unit is removably mountable with respect to the main body, so that the recording material can be discharged from the main body even when the unit is detached from the main body.

BRIEF DESCRIPTION OF THE DRAWINGS

FIG. 2 is seen from the direction of arrow N.

FIG. 2 is seen from the direction of arrow L.

DESCRIPTION OF THE PREFERRED EMBODIMENT

In the following, the embodiment of the present invention applied to an ink-jet recording apparatus will be explained with reference to the attached drawings.

Figure 1:
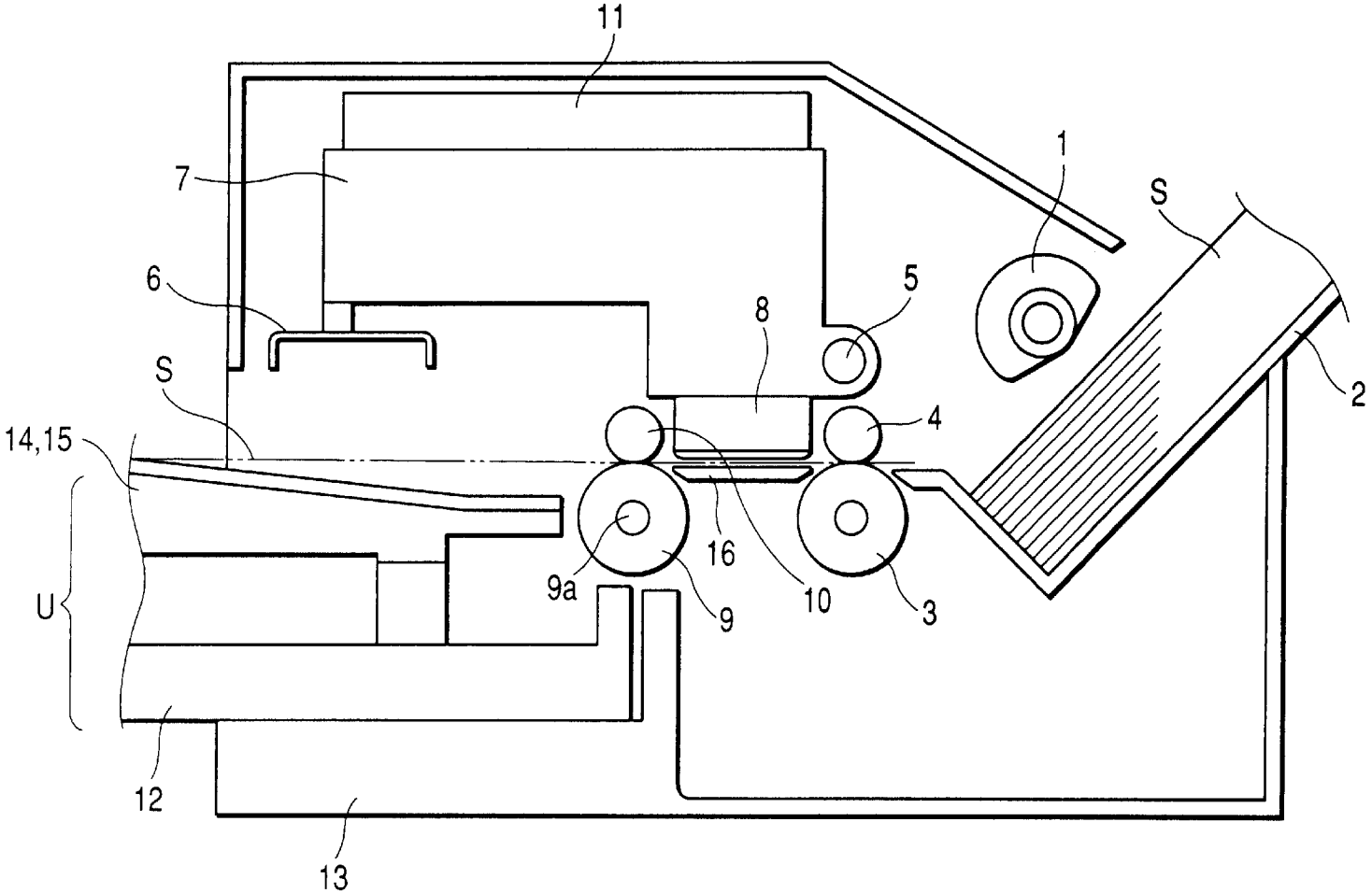
FIG. 1 is a cross-sectional illustration showing the construction of a recording apparatus according to the present invention.

Referring to FIG. 1, a feeding roller 1 is rotated by a motor (not shown). The feeding roller 1 feeds out recording materials S made of paper, synthetic resin or the like supported on a feeding tray 2 from the uppermost one, and separates and feeds the recording materials one by one by separating means (not shown). A conveying roller 3 is rotated by a motor (not shown), and a follower roller 4 is urged against and rotated by the conveying roller 3. The recording material S fed by the feeding roller 1 is held between the conveying roller 3 and the follower roller 4, and is conveyed to a recording position at which an ink jet recording head 8 (recording means) is opposed to the recording material.

This recording 8 is provided with a minute liquid discharge port (orifice), a liquid path, an energy acting portion provided in a portion of this liquid path, and energy generating means for generating liquid droplet forming energy caused to act on liquid in the acting portion. As the energy generating means, there is available a recording method using an electro-mechanical conversion member such as a piezoelectric element, a recording method using energy generating means for causing liquid droplets to be discharged by the action of heat generation resulting from the application of an electromagnetic wave such as a laser, or a recording method using energy generating means for heating liquid by an electro-thermal conversion member such as a heat generating element having a heat generating resistance member.

Among these methods, a recording head used in an ink jet recording method of discharging liquid by heat energy can accomplish recording of high resolution because it enables liquid discharge ports (orifices) for discharging liquid droplets for recording and forming liquid droplets for discharging to be arranged highly densely. Above all, a recording head using an electro-thermal conversion member as energy generating means can be easily made compact and can sufficiently enjoy the most of the merits of IC technology and micro-working technology which are remarkable in the advance and improvement in the reliability of the technique in the recent field of semiconductors, and is easy to equip with high density and is advantageous from its low manufacturing cost.

Also, if in the aforedescribed ink jet recording system, an electro-thermal conversion member is electrically energized in conformity with a recording signal, and by the growth and contraction of air bubbles created in ink by the utilization of film boiling caused in the ink by heat energy applied by the electro-thermal conversion member, the ink is discharged from discharge ports to thereby effect recording, which is more preferable. The typical construction and principle thereof are disclosed, for example, in U.S. Pat. No. 4,723,129 and U.S. Pat. No. 4,740,796.

A guide shaft 5 and a guide rail 6 are disposed in a direction orthogonal to the direction of conveyance of the recording material S (hereinafter referred to as the "widthwise direction"), and the recording head 8 is carried on a carriage 7 reciprocally movable along these. Also, a platen 16 is disposed at a location opposed to the recording head 8 with the conveyance route of the recording material S interposed therebetween, and is adapted to support the back of the recording material S held between and conveyed by the conveying roller 3 and the follower roller 4 to the recording position. The recording head 8 may be driven synchronously with the reciprocal movement of the carriage 7 so that ink droplets may be discharged from the head 8 onto the surface of the recording material S held between and conveyed by the conveying roller 3 and the follower roller 4 to thereby form an ink image. The recording head 8 has an ink tank 11 integrally provided on the upper portion thereof and is made removably mountable with respect to the carriage 7.

A discharge roller (discharging rotatable member) 9 rotated by a motor (not shown), and a spur 10 is urged against and rotated by the discharge roller 9. The recording material S conveyed by the conveying roller 3 and the follower roller 4 and having an ink image formed thereon by the recording head 8 is held between the discharge roller 9 and the spur 10 to be discharged out of the apparatus. The recording material S discharged from the main body is conveyed to recording material holding members (recording material holding means) 14 and 15 before it is discharged to a recording material discharge supporting portion 12*d* provided in a recording material discharge supporting unit U shown in FIG. 2, and is discharged while being held by these members.

Next, the recording material discharge supporting unit U comprising the recording material discharge supporting portion 12*d* and the recording material holding members 14 which 15 and are integrally made into a unit to be removably mountable with respect to the main body will be explained.

A base member (frame member of the unit U) 12, and one (14) of the recording material holding members 14 and 15 is made movable relative to the base member 12 in a widthwise direction in conformity with the size of the recording material S discharged from the main body by the recording material holding member holder (moving means) 17, and the other (15) is fixed to the base member 12 to effect the reference side holding of the recording material S.

Cover members 18 and 19 cover the recording material holding members 14 and 15, and a base member 13 of the main body positions and holds the unit U relative to the main body.

The construction and moving operation of the recording material holding member 14 will now be described.

Figure 2:
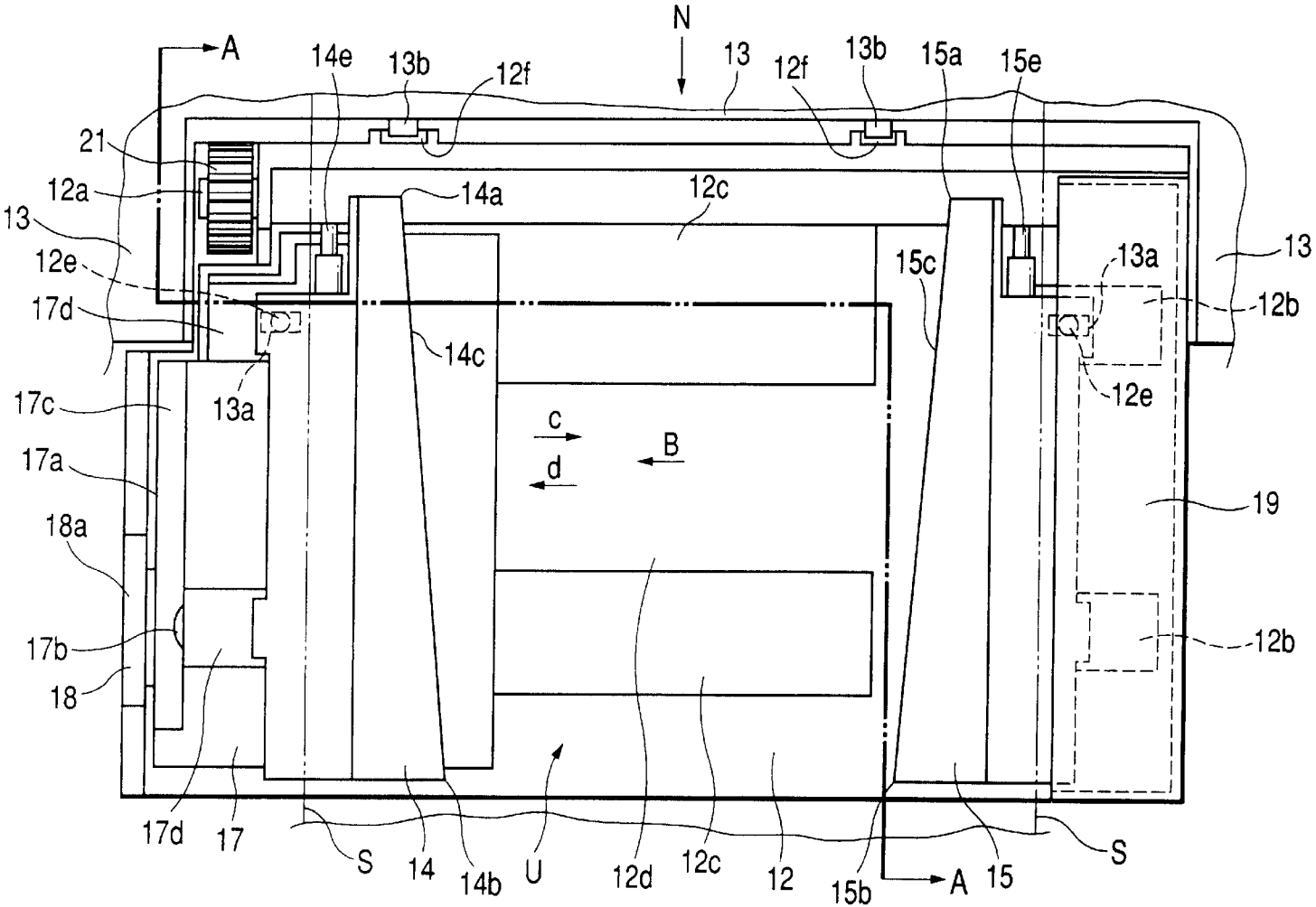
FIG. 2 is a plan view showing the construction of a recording material discharge supporting unit.
Figure 6:
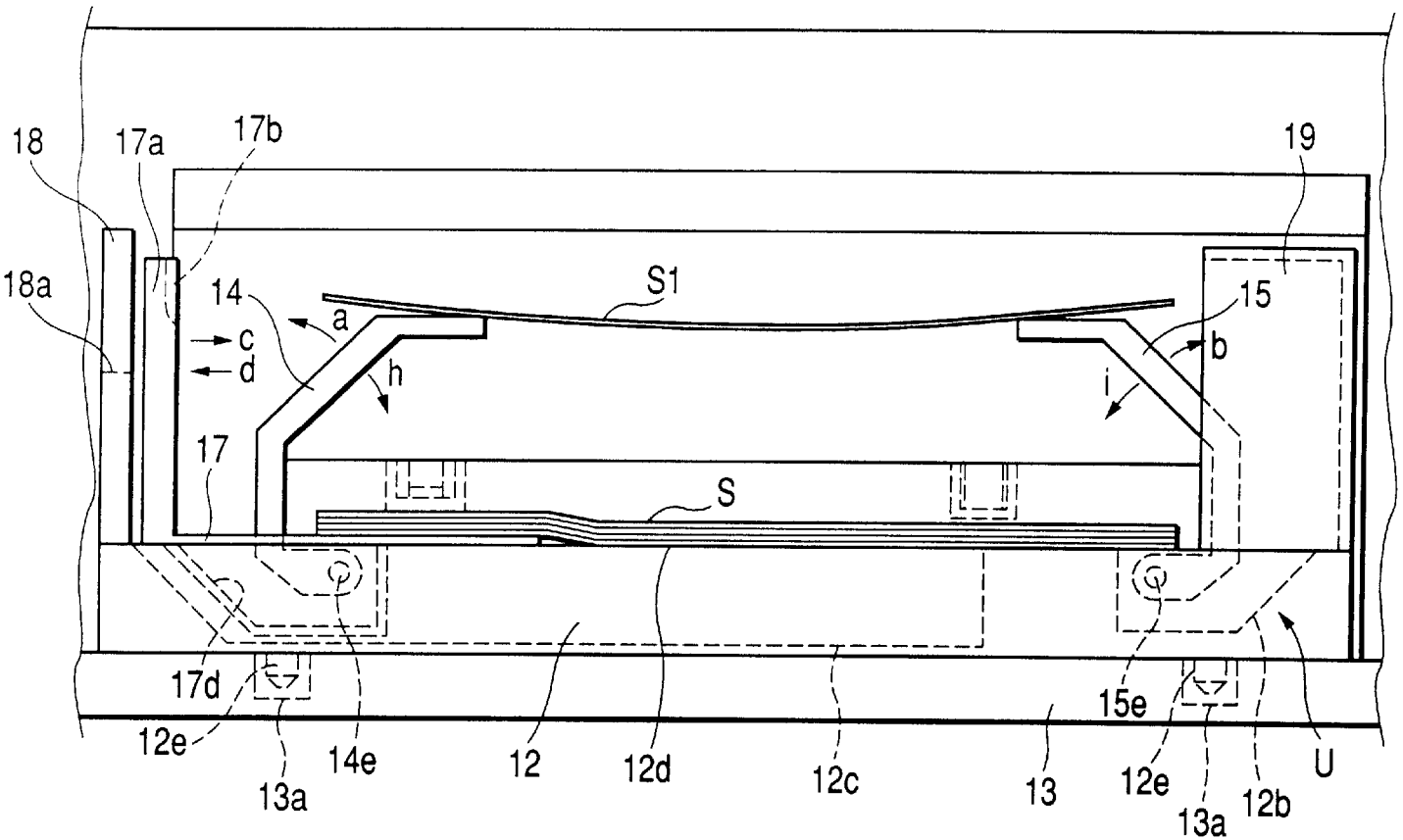
FIG. 6 is a front view showing the construction of the recording material discharge supporting unit and showing a state in which recording material holding means is in a holding position.
Figure 8:
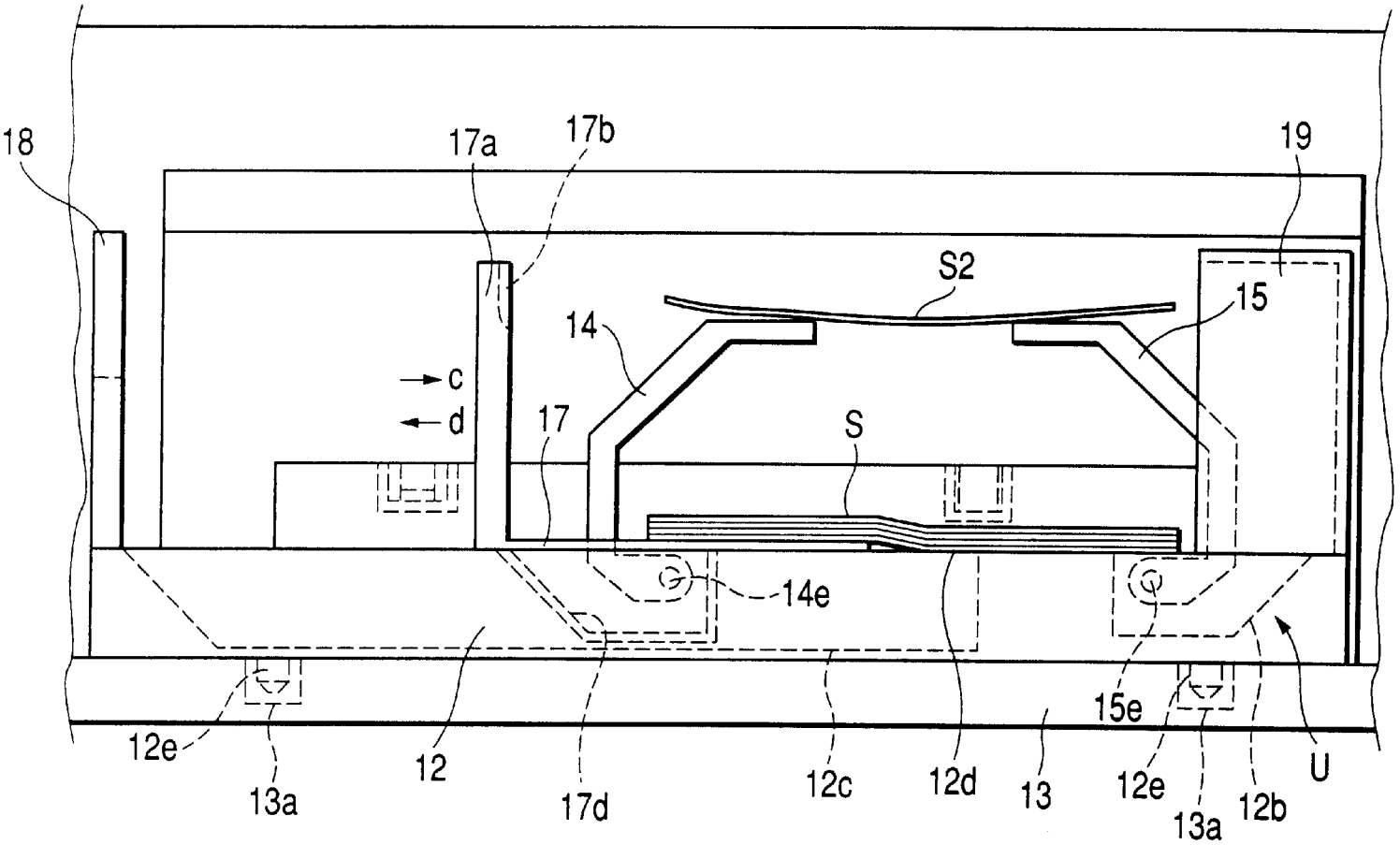
FIG. 8 is a front view showing the construction of the recording material discharge supporting unit and showing a state in which the recording material holding means is moved and holds a recording material of a small size.

The recording material holding member holder 17 is positioned and held relative to the base member 12 by a positioning holding portion (not shown), and a user can grasp a grip portion 17*a* provided on the recording material holding member holder 17 and move it in the directions of arrows c and d in FIG. 2 correspondingly to the size of the recording material S. As shown in FIG. 6, when a recording material S1 of a large size is discharged, the recording material holding member 14 is moved in the direction of arrow d in FIG. 2, and as shown in FIG. 8, when a recording material S2 of a small size is discharged, the recording material holding member 14 is moved in the direction of arrow c, whereby the recording materials S1 and S2 of large and small sizes are held.

Figure 5:
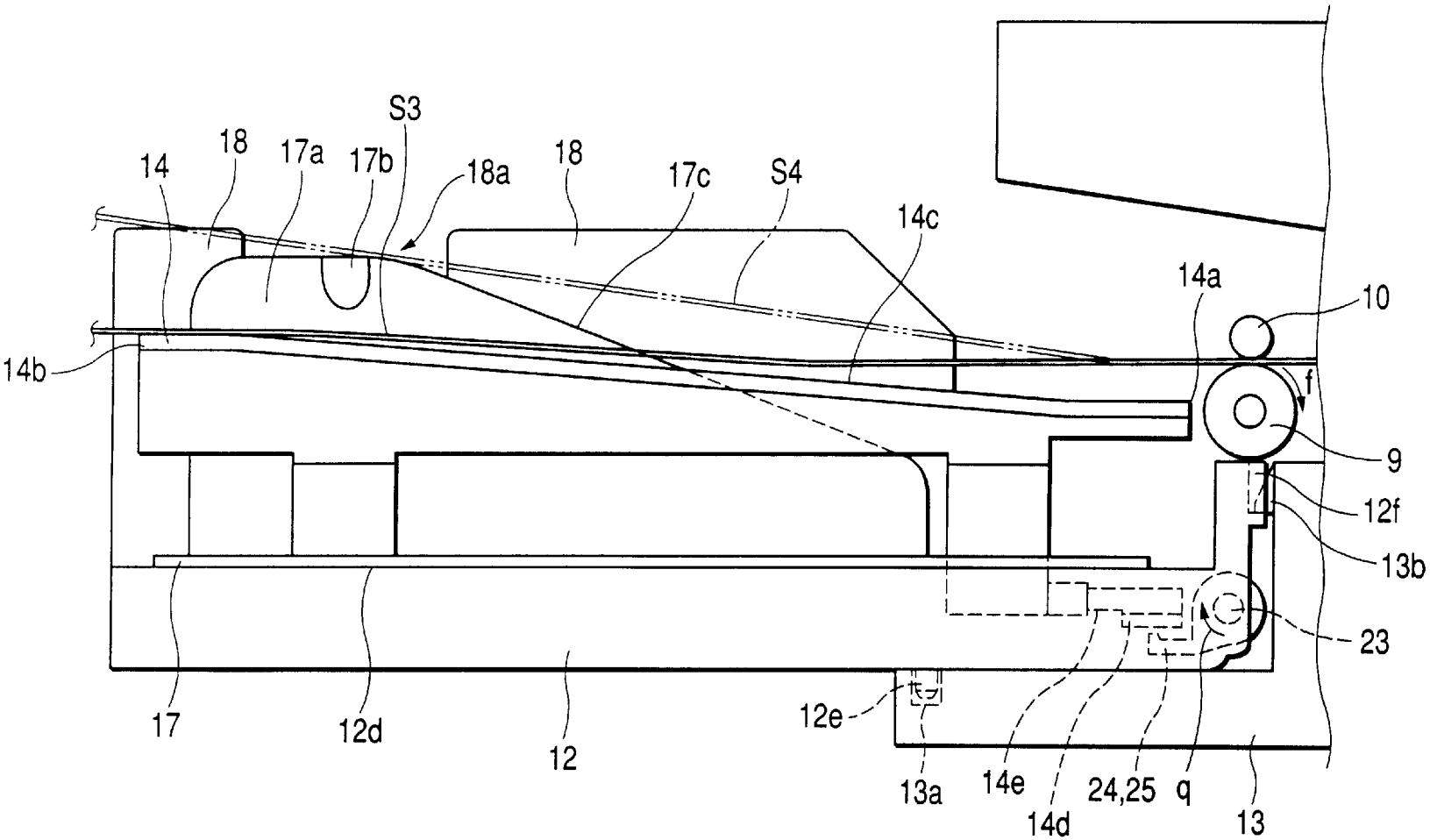
FIG. 5 is a view when

The grip portion 17*a* is provided with a recess 17*b* so that the user may easily grasp it, and further the upper surface of the grip portion 17*a* serves also as a guide for the recording material S discharged from the main body. As shown in FIG. 5, an inclined surface 17*c* upwardly inclined along the discharge direction (the leftward direction in FIG. 5) of the recording material S2 is formed continuously to the grip portion 17*a*.

Here, in the ordinary discharging operation, as indicated by the recording material S3 of FIG. 5, the recording material is discharged while being held by the recording material holding members 14 and 15. However, a problem arises when the user does not move the recording material holding member 14 to a position corresponding to the size of the recording material S (particularly if the recording material holding member 14 is set at the position of the small size shown in FIG. 8 when the recording material of the large size shown in FIG. 6 is discharged). That is, the recording material S and the grip portion 17*a* come to contact with each other, and as shown in FIG. 5, the recording material S4 is guided and discharged along the slope 17*c* of the grip portion 17*a*. In this embodiment, however, since the grip portion 17*a* has the function of a guide, the recording material S4 is discharged without jamming even when the user erroneously sets the set position of the recording material holding member 14.

Also, a cut-away portion 18*a* is formed in a cover member 18 at a location corresponding to the grip portion 17*a*, and even when the recording material holding member 14 is set to a large size, the user can operate it by grasping the grip portion 17*a* without interfering with the cover member 18.

Next, the shape of holding portions for the recording material S on the recording material holding members 14 and 15 will be explained.

As shown in FIG. 2, the recording material holding portions 14*c* and 15*c* of the recording material holding members 14 and 15 are shaped so as to be inwardly narrowed in a direction away from the discharge roller 9 for discharging the recording material S (so that the holding position for the recording material S may come into the inside of the recording material S along the upstream discharge sides 14*a* and 15*a* to the downstream discharge sides 14*b* and 15*b* of the recording material holding portions 14*c* and 15*c*). This is for maintaining the holding level for the recording material S on the downstream discharge side because as the recording material S goes away from the position held by the discharge roller 9 and the spur 10, the recording material S is downwardly curved from the held position by the gravity thereof and the weight of the ink by recording.

Figure 4:
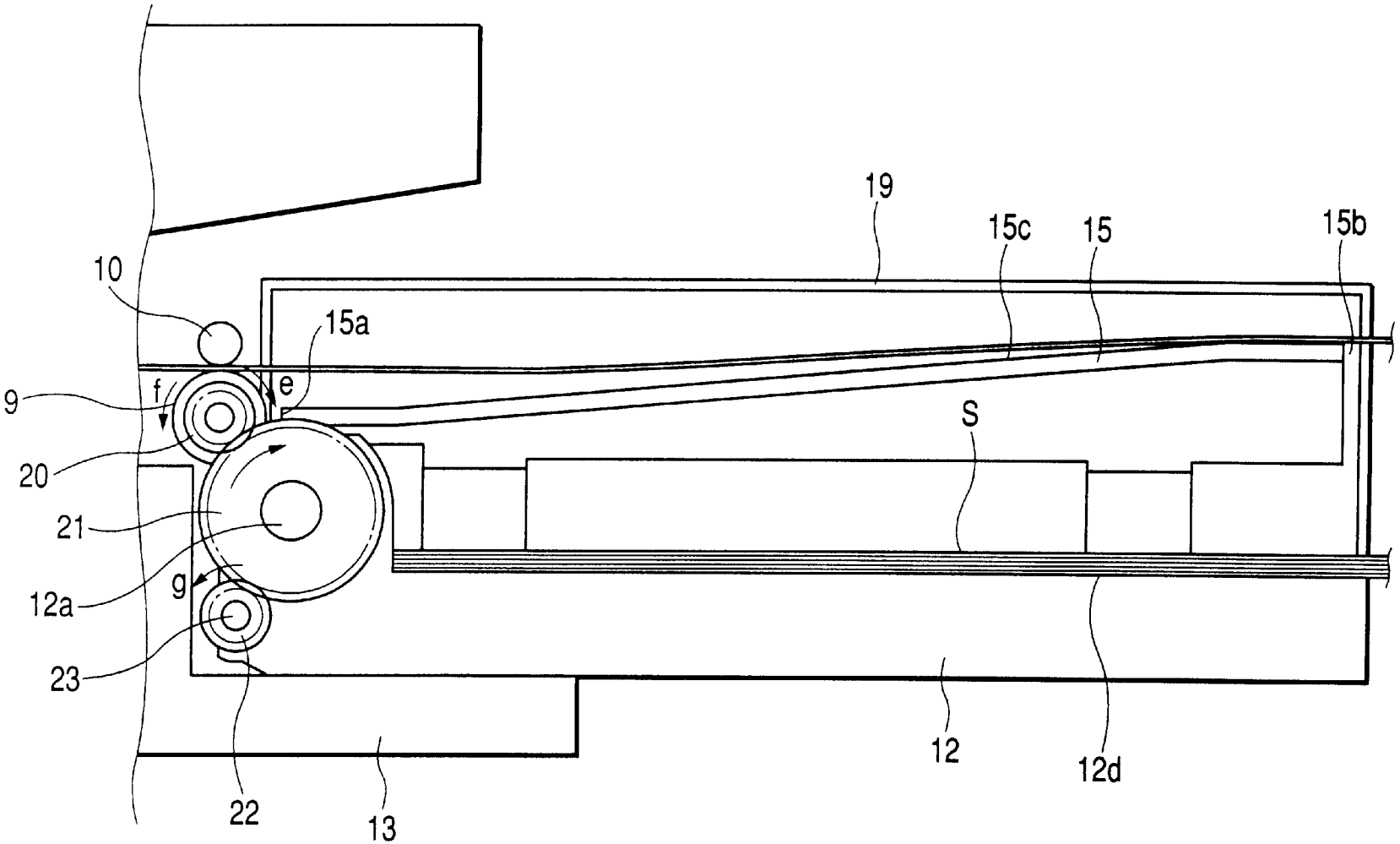
FIG. 4 is a cross-sectional view taken along the line 4—4 of FIG. 2.

Also, as shown in FIGS. 4 and 5, the level of the recording material holding portions 14*c* and 15*c* for holding the recording material S becomes higher along a direction away from the discharge roller 9 for discharging the recording material S. This is also for maintaining the holding level for the recording material S on the downstream discharge side because as the recording material S goes away from the position held by the discharge roller 9 and the spur 10, the recording material S is downwardly curved from the held position by the gravity thereof and the weight of the ink by recording.

Next, the opening-closing operation of the recording material holding members 14 and 15 and the driving construction therefor will be explained.

Figure 7:
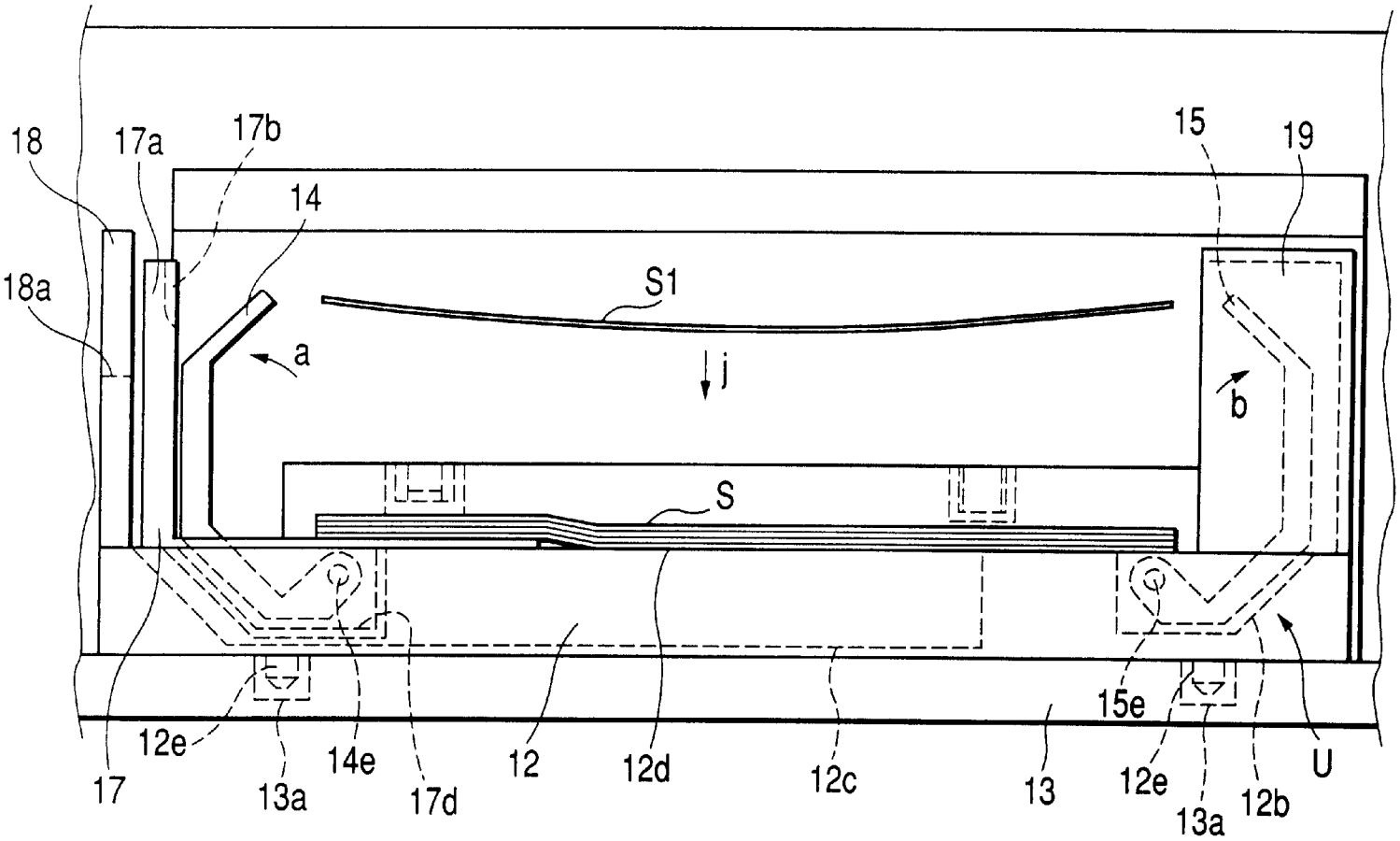
FIG. 7 is a front view showing the construction of the recording material discharge supporting unit and showing a state in which the recording material holding means is in a retracted position.

The recording material holding members 14 and 15 are rotatable in the directions of arrows a and b indicated in FIGS. 6 and 7 about rotation shafts 14e and 15*e* provided on a base member 12. Accordingly, they can be suitably changed to a holding position for holding the recording material S before the recording material S discharged from the main body is discharged to the recording material discharge supporting portion 12*d*, as shown in FIG. 6, and a retracted position for causing the recording material S to fall from its held state to the recording material discharge supporting portion 12*d* by gravity and supporting it, as shown in FIG. 7.

Figure 3:
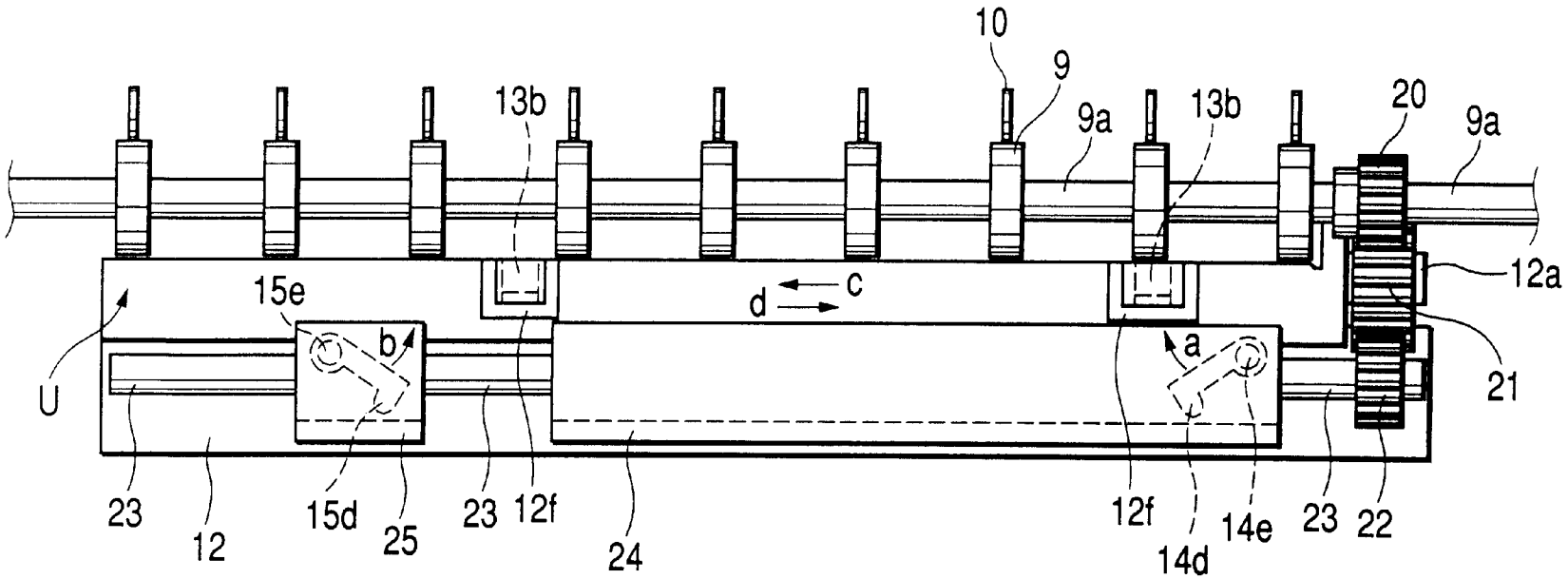
FIG. 3 is a side cross-sectional view showing the construction of the recording material discharge supporting unit when

As shown in FIG. 3, a driving gear 20 provided on the rotary shaft 9*a* of the discharge roller 9 is in meshing engagement with an idler gear 21 rotatably mounted on a shaft 12*a* provided on the base member 12. A one-way clutch (not shown) is provided on the driving gear 20, and by the action of the one-way clutch, in the rotative drive in a direction to discharge the recording material S in which the discharge roller 9 is forwardly rotated (the direction of arrow e in FIG. 4), the rotative driving force is not transmitted from the driving gear 20 to the idler gear 21, while in the rotative drive in the opposite direction in which the discharge roller 9 is reversely rotated (the direction of arrow f in FIG. 4), the rotative driving force is transmitted from the driving gear 20 to the idler gear 21.

Also, a torque limiter gear 22 meshing with the idler gear 21 and containing a torque limiter therein is rotatably mounted on a cam shaft 23. The torque limiter gear 22 is provided with a torque limit clutch mechanism for rotating the cam shaft 23 in the direction of arrow g in FIG. 4 by the predetermined idle rotational torque (slide torque) of the torque limiter during the reverse rotation of the discharge roller 9 in the direction of arrow f in FIG. 4.

The cam shaft 23 is held by a bearing portion (not shown), for rotation relative to the base member 12, and cams 24 and 25 for moving the recording material holding members 14 and 15 from the holding position shown in FIG. 6 to the retracted position shown in FIG. 7 are provided on the cam shaft 23 (refer to FIGS. 3 and 5).

On the other hand, the recording material holding members 14 and 15 are provided with rotation shafts 14e and 15*e* which are rotatably held by bearing portions (not shown) provided on the base member 12 and the recording material holding member holder 17. Cam surfaces 14d and 15*d* corresponding to the cams 24 and 25 are provided on the cam shaft 23 of the rotation shafts 14*e* and 15*e*, and by the rotation of the cam shaft 23, to be engaged with the cam surfaces 14*d*, 15*d* to thereby rotate the rotation shafts 14*e* and 15*e*. Thereby, the recording material holding members 14 and 15 can be moved from the holding position shown in FIG. 6 to the retracted position shown in FIG. 7.

The base member 12 and the recording material holding member holder 17 are formed with recesses 12*b* and 17*b* for the recording material holding members 14 and 15 to be rotated in the directions of arrows a and b in FIG. 7 about the rotation shafts 14*e* and 15*e* and moved to the retracted position. Also, the base member 12 is formed with a recess 12*c* as an escape for the recess 17*d* when the recording material holding member holder 17 is moved correspondingly to the size of the recording material S.

Next, the discharging and holding operation for the recording material S by the recording material holding members 14 and 15 will be explained.

As shown in FIG. 6, during the discharging of the recording material S1, the recording material holding members 14 and 15 are set in the holding position and hold the recording material S1. At this time, forces in the directions of arrows h and i in FIG. 6 are applied to the recording material holding members 14 and 15 by the biasing forces of resilient members (not shown). Also, the rotative driving force transmitted from the discharge roller 9 is held not to be transmitted to the holding members 14 and 15 by the one-way clutch mechanism provided on the driving gear 20.

Next, when the recording material S1 passes the discharge roller 9 and the discharging thereof is completed, the discharge roller 9 is reversely rotated to transmit the rotative driving force to the idler gear 21 and the torque limiter gear 22. By the idle rotational torque of the torque limiter gear 22, the cam shaft 23 is also rotated in the direction of arrow g in FIGS. 4 and 5. Thereby, the cams 24 and 25 fixed to the cam shaft 23 and the cam surfaces 14*d* and 15*d* fixed to the rotation shafts 14*e* and 15*e* of the recording material holding members 14 and 15 are engaged with each other to rotate the cam surfaces 14*d*, 15*d* and the rotation shafts 14*e*, 15*e* integrally in the directions of arrows a and b in FIG. 3, thus the recording material holding members 14 and 15 are moved to the retracted position shown in FIG. 7.

The driving force from the discharge roller 9 is transmitted still after the recording material holding members 14 and 15 are completely moved to the retracted position. However, when predetermined or greater torque is created, sliding occurs by the torque limit clutch mechanism provided on the torque limiter gear 22 to prevent the driving system and the recording material holding members 14 and 15 from damage by an overload.

The one-way clutch and the torque limit clutch mechanism can be ones having a one-way clutch mechanism. As the simplest construction thereof, there can be provided a torsion coil spring having predetermined interference on a shaft and an engagement portion on a gear side.

As shown in FIG. 7, when the recording material holding members 14 and 15 are moved to the retracted position, the recording material S1 falls in the direction of arrow j by gravity and is supported on the recording material discharge supporting portion 12*d* provided on the base member 12.

As shown in FIG. 3, the cam 24 has a length corresponding to the length over which the recording material holding member 14 is moved in the directions of arrows c and d, so that the cam 24 is normally positioned in a state to be engaged with the cam surface 14*d*. The above-described operation is possible even if a recording material S of a different size is discharged.

The recording operation onto the recording material and the discharging operation are terminated with the recording material holding members 14 and 15 moved to the retracted position shown in FIG. 7. At this time, the recording material holding member 15 is held in a state to be contained in the cover member 19, and therefore it is protected against the extraneous force of a falling object or the like. Also, when the holding member 15 is held in the retracted position shown in FIG. 7, the rigidity thereof against the extraneous force of a falling object or the like becomes greater, which is preferable.

Next, the operation of mounting and dismounting the recording material discharge supporting unit U with respect to the main body will be explained.

Figure 9:
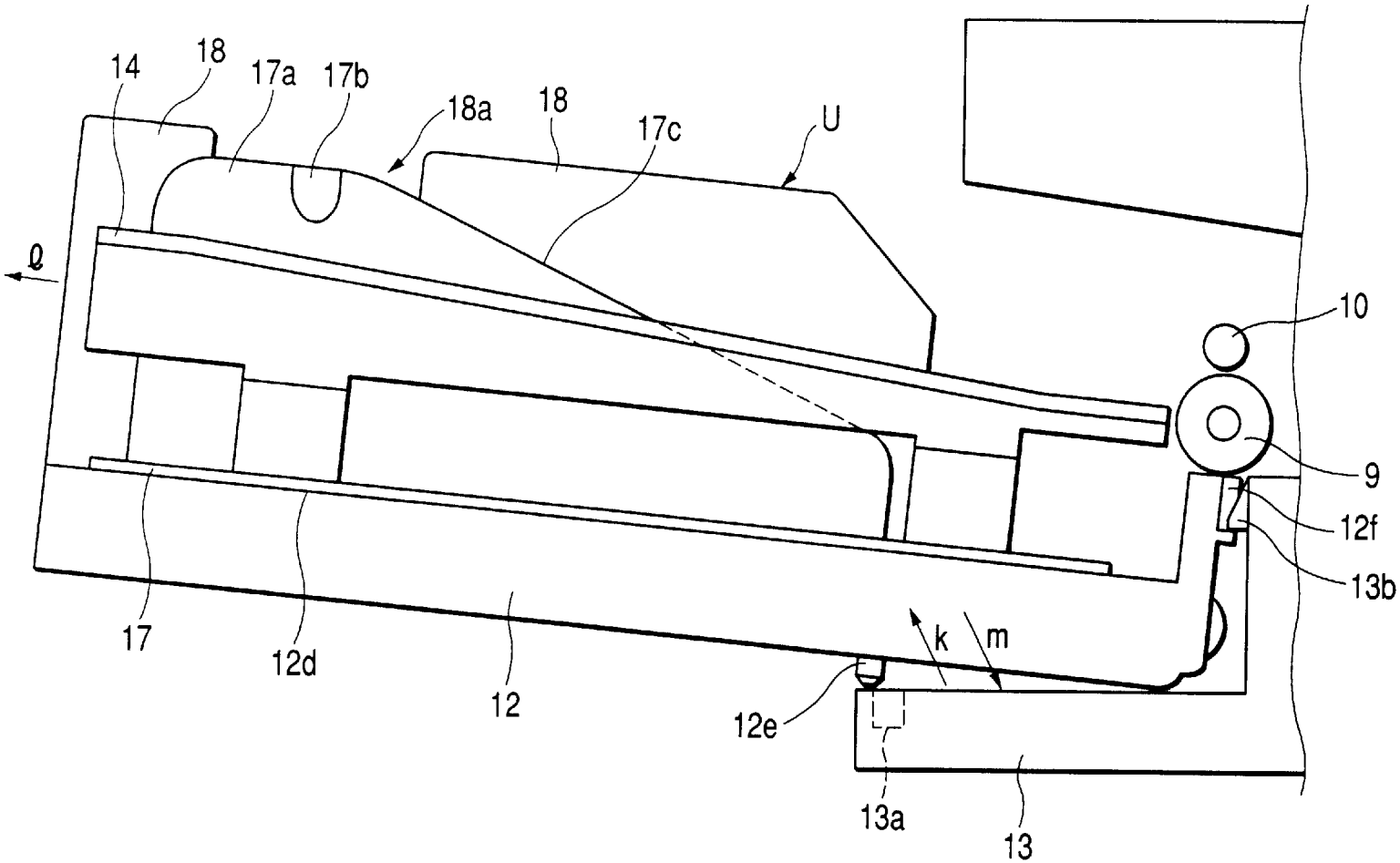
FIG. 9 shows the manner in which the recording material discharge supporting unit is detached or mounted with respect to the main body of the recording apparatus.
Figure 10:
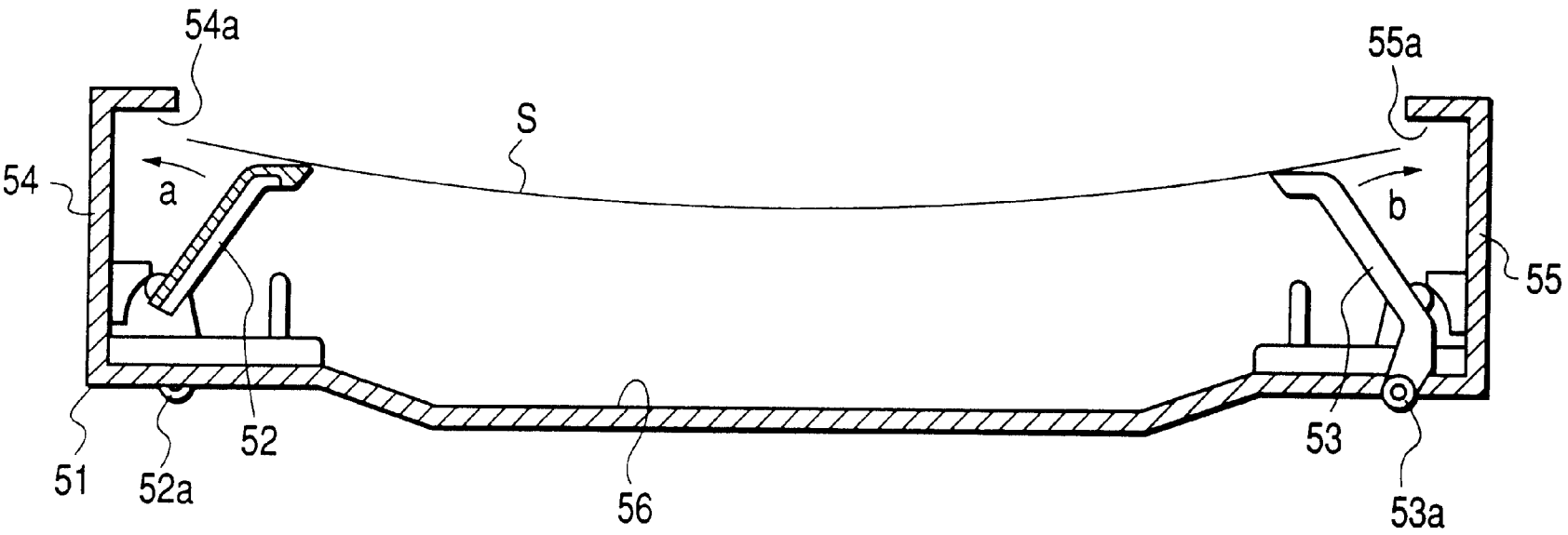
FIG. 10 is an explanation view of the conventional art.

As shown in FIG. 9, positioning pins 12*e* provided at two locations on the back of the base member 12 of the recording material discharge supporting unit U corresponding to positioning grooves 13*a* formed at two locations on the base member 13 of the main body are fitted into the positioning grooves 13*a* and positioned, so that the positioning of the recording material discharge supporting unit U in the discharge direction of the recording material S relative to the main body is performed. Also, positioning projections 13*b* provided at two locations on the base member 13 of the main body corresponding to positioning engagement portions 12*f* provided at two locations on the discharge roller 9 of the base member 12 of the unit U are brought into engagement with the engagement portions 12*f*, so that the positioning of the recording material discharge supporting unit U in the height direction and widthwise direction thereof relative to the main body is performed.

When the recording material discharge supporting unit U is dismounted from the main body, the unit U is raised in the direction of arrow k in FIG. 9 and the positioning pins 12*e* provided on the base member 12 of the unit U are removed from the positioning grooves 13*a* of the base member 13, whereafter the unit U can be drawn out in the direction of arrow l in FIG. 9 to thereby release the engagement between the projections 13*b* of the base member 13 and the engagement portions 12*f* of the base member 12 of the recording material discharge supporting unit U.

Also, when the recording material discharge supporting unit U is mounted on the main body, the unit U is inclined as shown in FIG. 9 and pushed onto the base member 13 of the main body to bring the projections 13*b* of the base member 13 into engagement with the engagement portions 12*f* of the base member 12 of the unit U. Thereafter, the unit U can be lowered in the direction of arrow m in FIG. 9 to thereby fit the positioning pins 12*e* of the base member 12 of the unit U into the positioning grooves 13*a* of the base member 13.

By the above-described construction, the recording material discharge supporting unit U can be dismounted from the main body, leaving the portions necessary for the discharging of the recording material S by the discharge roller 9 and the spur 10. Therefore, when a recording material S having good fixativeness for ink is used and the unit U is not required, the recording material S can be discharged from the main body even when the unit U is detached therefrom.

Also, during the transportation of the recording apparatus, the main body can be packed up with the recording material discharge supporting unit U dismounted therefrom, and therefore the space efficiency during the packing is good. Also, the recording material discharge supporting unit U can be carried separately from the main body, which is convenient for the carrying of the recording apparatus.

In the aforedescribed embodiment, the recording material holding member 14 is moved corresponding to the widthwise size of the recording material S. However, corresponding to the size of the recording material S in the direction of conveyance (hereinafter referred to as the lengthwise direction), the recording material holding member 14 is moved in the discharge direction of the recording material S. In this case, holding performance corresponding to a different size of the recording material S in the lengthwise direction thereof can be improved.

Also, if a construction in which, corresponding to both of the widthwise direction and lengthwise direction of the recording material S, the position of the recording material holding member 14 is moved in both of the widthwise and discharge directions of the recording material S, holding performance corresponding to a different size of the recording material S can be further improved.

Also, in the aforedescribed embodiment, the reference side of the recording material S corresponds to the recording material holding member 15 side, and therefore the holding member 15 is fixed and the recording material holding member 14 is moved. However, when the reference side of the recording material S can be selected as the recording material holding member 14 side, the holding member 14 is fixed and the recording material holding member 15 is moved. Also, when the recording material S is recorded and discharged with the central reference, both of the recording material holding members 14 and 15 can be constructed movably with the central reference.

Also, in the aforedescribed embodiment, construction in which the recording material holding member holder 17 having the recording material holding member 14 slides and is positioned relative to the base member 12 of the recording material discharge supporting unit U is explained. However, a plurality of positioning portions can be provided at locations on the base member 12 of the unit U corresponding to the sizes of the recording material S to bring selectively positioning portions provided on the recording material holding member holder 17 into engagement with the plurality of positioning portions in conformity with the size of the recording material S to be fixed.

The forms of the aforedescribed ink jet recording apparatus may be, besides one used as the image output terminal apparatus of an information processing instrument such as a computer, a copying apparatus combined with a reader, and a facsimile apparatus having the transmitting and receiving functions. Also, the recording system is not restricted to the ink jet recording system, but is replaceable with recording apparatuses of other recording systems. Further, the ink-jet is not restricted to the serial recording system, but may be the so-called line recording system.

According to the present invention, even when a recording material of a different size is discharged, it can be prevented from rubbing against an already discharged recorded recording material, so that the disturbance of the recording surface (image) thereof can be prevented, and the dischargeability and supportability thereof can be improved.

Also, in the rotative driving of the discharging rotatable member (discharge roller) in the discharge direction of the recording material, the recording material holding means is in its holding position, while in the rotation in the opposite direction, in the discharging operation for the recording material, the recording material holding means is normally in its holding position, and after the termination of the discharging of the recording material, the recording material holding means is changed to its retracted position by the reverse rotating operation of the discharging rotatable member. Therefore, the discharging operation and the holding operation can be smoothly performed by the simple construction of a driving system.

Also, on the rotary shaft of the discharging rotatable member, there is provided a one-way clutch which does not transmit the drive to the recording material holding means during the rotation thereof in the discharge direction. Therefore, during the rotation of the discharging rotatable member in the discharge direction of the recording material, the recording material holding means can be easily maintained in its holding position. Also, the discharging of the recording material is completed with the recording material holding means changed to its retracted position, and the holding means is intactly held in its retracted position. Therefore, the rigidity against the extraneous force by a falling object or the like to the recording material holding means becomes great.

Also, the grip portion of the recording material holding member holder serves also as a guide for the discharge recording material, so that even when the user does not effect the alignment of the size of the discharged recording material and the recording material holding members, the recording material can be discharged without jamming. Also, the torque limiter for limiting the transmission of the driving force in the direction to change the recording material holding means to its retracted position is provided in the driving system for the holding means, so that not only the holding means can be reliably positioned in its retracted position but also the damage to the driving system and the recording material holding means by an overload can be prevented to secure the preservation of the apparatus.

Also, the recording material discharge supporting unit is removably mountable with respect to the main body, and the discharging of the recording material can be effected even when the unit is detached from the main body. As a result, when a recording material having good fixativeness is used and the recording material discharge supporting unit is not always required, ordinary discharging can be effected even if the recording material discharge supporting unit is dismounted. Further, during transportation, the main body can be packed up with the recording material discharge supporting unit dismounted therefrom, so that the space efficiency during the packing is improved.

Also, when it is constructed that the level at which the recording material holding means holds the recording material becomes higher away from the recording material discharging means or the holding position for the recording material comes into the inside of the recording material, even if the recording material is of a large size and the recording density thereof is high, the holding of the recording material can be stably made possible without making the recording material holding means larger than length necessary in the direction of discharge of the recording material.

What is claimed is:

1. A recording apparatus comprising:

a recording material support that supports a discharged recording material thereon;

a holder movable between (i) a holding position in which said holder holds the discharged recording material prior to the discharged recording material being supported by said recording material support, and (ii) a retracted position in which said holder allows the discharged recording material to be supported by said recording material support;

a first support that supports said holder so that said holder is movable between the holding position and the retracted position;

a second support that supports said first support so that said first support is movable to a position corresponding to a size of the discharged recording material; and a torque limiter, provided in a driving system for said holder, for limiting transmission of a driving force in a direction in which said holder is moved from the holding position to the retracted position.

2. A recording apparatus according to claim 1, further comprising:

recording material discharging means for discharging a recording material, and drive transmitting means for transmitting a drive from said recording material discharging means to said holder so that said holder is moved from the holding position to the retracted position.

3. A recording apparatus according to claim 2, wherein said recording material discharging means includes a discharging rotatable member for discharging the recording material, and during rotation of said discharging rotatable member in a direction to discharge the recording material, said holder is set at the holding position, and during rotation of said discharging rotatable member in a direction opposite to the direction to discharge the recording material, said holder is set at the retracted position.

4. A recording apparatus according to claim 3, wherein said rotatable member comprises a rotary shaft provided with a one-way clutch, which does not transmit a driving force to said holder during the rotation of said discharging rotatable member in the direction in which the recording material is discharged, and which transmits the driving force to said holder during the rotation of said discharging rotatable member in the direction opposite to the direction in which the recording material is discharged.

5. A recording apparatus according to claim 1, wherein said holder is moved from the holding position to the retracted position, and thereafter said holder is held in the retracted position.

6. A recording apparatus according to claim 1, wherein said holder includes a recording material holding member movable between the holding position and the retracted position, said second support includes a recording material holding member support for supporting and moving said first support to the position corresponding to a size of the discharged recording material, and said recording material holding member support includes a grip portion to be gripped for a movement of said recording material holding member support, said grip portion serving as a guide for the discharged recording material.

7. A recording apparatus according to claim 6, further comprising, in the driving system for said holder, a cam for moving said holder from the holding position to the retracted position, wherein said cam and said recording material holding member are engaged with each other within a range of movement of said recording material holding member support.

8. A recording apparatus according to claim 1, further comprising recording material discharging means for discharging a recording material, wherein said holder is constructed such that the recording material is held higher as the recording material moves away from said recording material discharging means.

9. A recording apparatus according to claim 1, further comprising recording material discharging means for discharging a recording material, wherein said holder is constructed such that the recording material is held more towards the center as the recording material moves away from said recording material discharging means.

10. A recording apparatus according to any one of claims 1 to 6 or 7 to 9, further comprising recording means for recording on the recording material, wherein said recording means includes an ink jet recording system for discharging the ink in conformity with a signal to effect recording.

11. A recording apparatus according to claim 10, wherein said recording means utilizes film boiling created in the ink by heat energy applied by an electro-thermal conversion member to thereby cause the ink to discharge from a discharge port.

12. A recording apparatus comprising:

a mounting portion to which a recording material discharge supporting unit is detachably mounted, said recording material discharge supporting unit including:

a recording material support that supports thereon a recording material discharged from a main body of said recording apparatus, and a holder movable between (i) a holding position in which said holder holds the recording material discharged from the main body prior to the recording material being supported by said recording material support, and (ii) a retracted position in which said holder allows the recording material to be supported by said recording material support, wherein even when said recording material discharge supporting unit is detached from the main body, the main body of said recording apparatus discharges the recording material; and recording means for recording on the recording material, wherein said recording means includes an ink jet recording system for discharging ink in conformity with a signal to effect recording, wherein said recording means utilizes film boiling created in the ink by heat energy applied by an electro-thermal conversion member to thereby cause the ink to discharge from a discharge port.

13. A recording apparatus according to claim 12, further comprising, in the driving system for said holder, a torque limiter for limiting transmission of a driving force in a direction in which said holder is moved from the holding position to the retracted position.

14. A recording apparatus comprising:

a platform for supporting a paper sheet that has been discharged from said recording apparatus;

a plurality of shutters movable between (i) a raised position in which the sheet is supported on said plurality of shutters above said platform, and (ii) a retracted position adapted to allow the sheet to be supported on said platform;

a plurality of shafts supporting each of said plurality of shutters;

a frame movably disposed on a base, said frame supporting at least one of said plurality of shafts, wherein at least one shutter is movable with respect to the base to accommodate different sheet sizes; and a torque limiter, provided in a driving system for said plurality of shutters, for limiting transmission of a driving force in a direction in which said plurality of shutters are moved from the raised position to the retracted position.

* * * * *

UNITED STATES PATENT AND TRADEMARK OFFICE

CERTIFICATE OF CORRECTION

PATENT NO. : 6,464,350 B1
DATED : October 15, 2002
INVENTOR(S) : Haruo Uchida

It is certified that error appears in the above-identified patent and that said Letters Patent is hereby corrected as shown below:

Title page,
Item [30], Foreign Application Priority Data,

"Dec. 11, 1997 (JP) …… 9-310411" should read -- Nov. 12, 1997 (JP) …….. 9-310411 --.

Column 1,
Line 10, "after" should be deleted; and
Line 59, "synchronous" should read -- synchronously --.

Column 6,
Line 18, "which 15 and" should read -- and 15 which --.

Column 9,
Line 64, "arrow 1" should read -- arrow $\ell$ --.

Signed and Sealed this

Twentieth Day of May, 2003

JAMES E. ROGAN
*Director of the United States Patent and Trademark Office*